US007185501B2

(12) United States Patent
Steinbach

(10) Patent No.: US 7,185,501 B2
(45) Date of Patent: Mar. 6, 2007

(54) CRYOGENIC COOLING SYSTEM AND METHOD WITH BACKUP COLD STORAGE DEVICE

(75) Inventor: Albert Eugene Steinbach, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 232 days.

(21) Appl. No.: 11/012,258

(22) Filed: Dec. 16, 2004

(65) Prior Publication Data

US 2006/0266054 A1 Nov. 30, 2006

(51) Int. Cl.
*F25B 7/00* (2006.01)

(52) U.S. Cl. ..... 62/79; 62/434

(58) Field of Classification Search ..... 62/50.4, 62/50.7, 51.1, 79, 434, 505, 198, 513; 310/52, 310/54, 62, 64
See application file for complete search history.

(56) References Cited

U.S. PATENT DOCUMENTS 3,375,675 A * 4/1968 Trepp et al. ..... 62/48.2
4,035,678 A * 7/1977 Lambrecht et al. ..... 310/52
4,101,793 A * 7/1978 Berthet et al. ..... 310/52
5,060,481 A * 10/1991 Bartlett et al. ..... 62/51.2
5,150,579 A * 9/1992 Hingst ..... 62/51.2
5,429,177 A 7/1995 Yaron et al.
5,647,218 A * 7/1997 Kuriyama et al. ..... 62/6
5,848,532 A * 12/1998 Gamble et al. ..... 62/48.2
6,173,577 B1 * 1/2001 Gold ..... 62/51.1
6,318,090 B1 11/2001 Gschneidner, Jr. et al.
6,354,087 B1 * 3/2002 Nakahara et al. ..... 62/6
6,415,613 B1 7/2002 Ackermann et al.
6,438,969 B1 8/2002 Laskaris et al.
6,442,949 B1 9/2002 Laskaris et al.
6,640,552 B1 * 11/2003 Rampersad et al. ..... 62/6

(Continued)

FOREIGN PATENT DOCUMENTS

EP 1 276 215 1/2003

(Continued)

OTHER PUBLICATIONS

Britcliffe et al., "A 2.5-Kelvin Gifford-McMahon/Joule-Thomson Cooler for Cavity Maser Applications", IPN Progress Report 42-147, pp. 1-9 (Nov. 15, 2001).

*Primary Examiner*—Mohammad M. Ali
(74) *Attorney, Agent, or Firm*—Nixon & Vanderhye P.C.

(57) ABSTRACT

A cooling system for providing cryogenic cooling fluid to a thermal load, the system comprising: a main cryogenic refrigeration system; a cryogenic cooling fluid feed line having a feed line outlet coupled to the thermal load and a feed line inlet coupled to the cryogenic refrigeration system; a cryogenic cooling fluid return line having a return line inlet coupled to the thermal load and a return line outlet coupled to the cryogenic refrigeration system; a bypass cooling system further comprising isolation valves attached to the feed line and return line wherein each of said valves has a closed position and an open position, a bypass line extending between the feed line and return line, a bypass valve and a cooling device attached to one of said feed line and return line. The bypass cooling system may further include a cold box housing the bypass line and the cooling device, e.g., an open or closed heat exchanger coupled to a storage tank of cryogen.

20 Claims, 5 Drawing Sheets

U.S. PATENT DOCUMENTS 6,708,503 B1 * 3/2004 Wang et al. ..... 62/51.1
6,748,755 B2 * 6/2004 Kubo et al. ..... 62/225
6,812,601 B2 11/2004 Gable et al.
7,003,977 B2 * 2/2006 Steinbach et al. ..... 62/437

FOREIGN PATENT DOCUMENTS

JP 6-265230 A * 9/1994

* cited by examiner

CRYOGENIC COOLING SYSTEM AND METHOD WITH BACKUP COLD STORAGE DEVICE

BACKGROUND OF THE INVENTION

The present invention relates to cryogenic refrigeration systems for cooling a superconducting device, such as a synchronous machine having a rotor with a high temperature superconducting component.

Cryogenic refrigerators are often used to cool thermal loads, such as a high-temperature superconducting field winding of a rotor in a synchronous electrical generator (HTSG). The field winding is cooled to cryogenic temperatures through an external cryogenic refrigerator that circulates cold helium gas through a fluid circuit to the field winding in the rotor.

Cryogenic cooling is necessary for a superconducting generator. The rotor field winding loses its superconducting capacity when heated above cryogenic temperatures. To ensure continuous generator operation, cryogenic cooling fluid should be constantly supplied to the super-conducting field winding. If the refrigerator fails, the temperature of the cooling fluid rises and the field winding warms enough to quench and cease to be superconducting. A backup refrigeration system is typically used to provide a constant source of cooling fluid for the field winding, especially in situations where the main cooling system fails or requires maintenance.

Conventional cryogenic refrigeration systems include Gifford-McMahon, Pulse Tube, Stirling and reverse Brayton refrigeration systems. FIGS. 4 and 5 schematically show a HTS generator rotor coil winding 102 being cooled by representative cryocooler refrigeration systems. FIG. 4 shows a cryocooler system 100 that uses coldheads 114 of a Gifford-McMahon (GM), pulse tube (PT), or Stirling system to cool the cooling fluid (typically helium gas at 20° Kelvin) circulated through the high temperature, super conducting (HTS) rotor coil 102. The refrigeration system 100 includes a circulating compressor(s) 104 that moves refrigeration fluid through the pipe lines 106 in the system 100 and between the system and the rotor 102. The refrigeration system includes a circulation heat exchanger 108, a bypass valve 110, a plurality of coldhead compressors 112 and coldheads 114 for a Gifford-McMahon or Pulse tubes system, and a coldhead heat exchanger 116.

FIG. 5 shows an alternative cryocooler system 120 that uses a Reverse-Brayton type refrigerator 120 to cool the fluid circulated through the rotor. Cryogenic cooling fluid cools a superconducting winding in a HTS rotor 102. The cooling fluid flows through a circuit 106 having feed and return lines to and from the rotor. The refrigerator 120 includes a compressor and oil removal device 122 that filters and compresses the cooling fluid, e.g., helium gas, and passes the compressed fluid to a circulating heat exchanger (s) 124 in a cold box 125. A turbo expander 126 causes the fluid to cool before it is fed to the rotor 102.

In both conventional cryogen cooling systems 100, 120, there are multiple components that can individually cause the refrigeration system to fail by not working. These components require redundancy, and special systems and procedures so that they can be removed temporarily without adding to the heat load of the refrigeration system.

The main cryogenic cooling system tends to be an expensive component in a high-temperature super-conducting generator (HTSG). A conventional cooling system with redundant components or a redundant cooling system further increases the cost of the cryogenic cooling system. Redundant components in a conventional cooling system may include compressors and coldheads. Alternatively, a redundant main cooling system may been provided to a conventional cooling system. In addition, conventional cooling systems tend to employ elaborate devices to facilitate the removal of redundant cooling components, e.g., the coldheads, for refurbishment while the generator remains on-line. Even so, there are some cooling components that are traditionally serviced by taking the cooling system and generator off-line, e.g., filters and turbines, which negatively affect generator availability and reliability.

There is a long-felt need for simple, inexpensive and reliable cryogen cooling systems that enable all components (or a large portion of components) of the main refrigeration system 100, 120 to be serviced without disrupting the generator operation. Further, there is a need for a system that reduces the redundancy of components in the main refrigeration system and that enables relatively simple means for removal of refrigeration components for refurbishment while the generator is on-line. Moreover, there is a need for a refrigeration system that enables rapid cooldown of the rotor coil during generator startup procedures.

BRIEF DESCRIPTION OF THE INVENTION

The invention may be embodied as a cooling system for providing cryogenic cooling fluid to a thermal load, the system comprising: a main cryogenic refrigeration system; a cryogenic cooling fluid feed line having a feed line outlet coupled to the thermal load and a feed line inlet coupled to the cryogenic refrigeration system; a cryogenic cooling fluid return line having a return line inlet coupled to the thermal load and a return line outlet coupled to the cryogenic refrigeration system; a bypass cooling system further comprising isolation valves attached to the feed line and return line wherein each of said valves has a closed position and an open position, a bypass line extending between the feed line and return line, a bypass valve and a cooling device attached to one of said feed line and return line. The bypass cooling system may further comprise a cold box housing the bypass line and the cooling device, e.g., an open or closed heat exchanger coupled to a storage tank of cryogen.

The invention may also be embodied as a cryogen backup cooling system adapted to be positioned between a main cryogen cooling system and a thermal load, the backup cooling system comprising: a first isolation valve in a cooling fluid feed line, wherein said feed line has a cooling fluid feed line inlet connectable to the main cryogen cooling system and an outlet connectable to the thermal load; a second isolation valve in a cooling fluid return line, said return line having a return line inlet connectable to the thermal load and an outlet to the return line connectable to the main cryogen cooling system; a bypass line connectable to the feed line between the first isolation valve and the thermal load and connectable to the return line between the second isolation valve and the thermal load, and a cooling device connected to one of the return line and feed line between the bypass line and the thermal load.

The invention may be further embodied as a method of providing a cryogen cooling fluid to a thermal load, the method comprising: cooling the fluid in a main cryogenic refrigerator; transferring the cooled fluid from the main cryogenic refrigerator through a feed line to the thermal load; cooling the thermal load with the cooled fluid and returning the fluid through a return line to the main cryogenic refrigerator; blocking the fluid flowing from and to the main cryogenic refrigerator; recirculating the fluid from the feed line through a bypass line and back in the feed line, while blocking the main cryogenic refrigerator, and cooling the recirculating fluid in a heat exchanger.

DETAILED DESCRIPTION OF THE INVENTION

Figure 1:
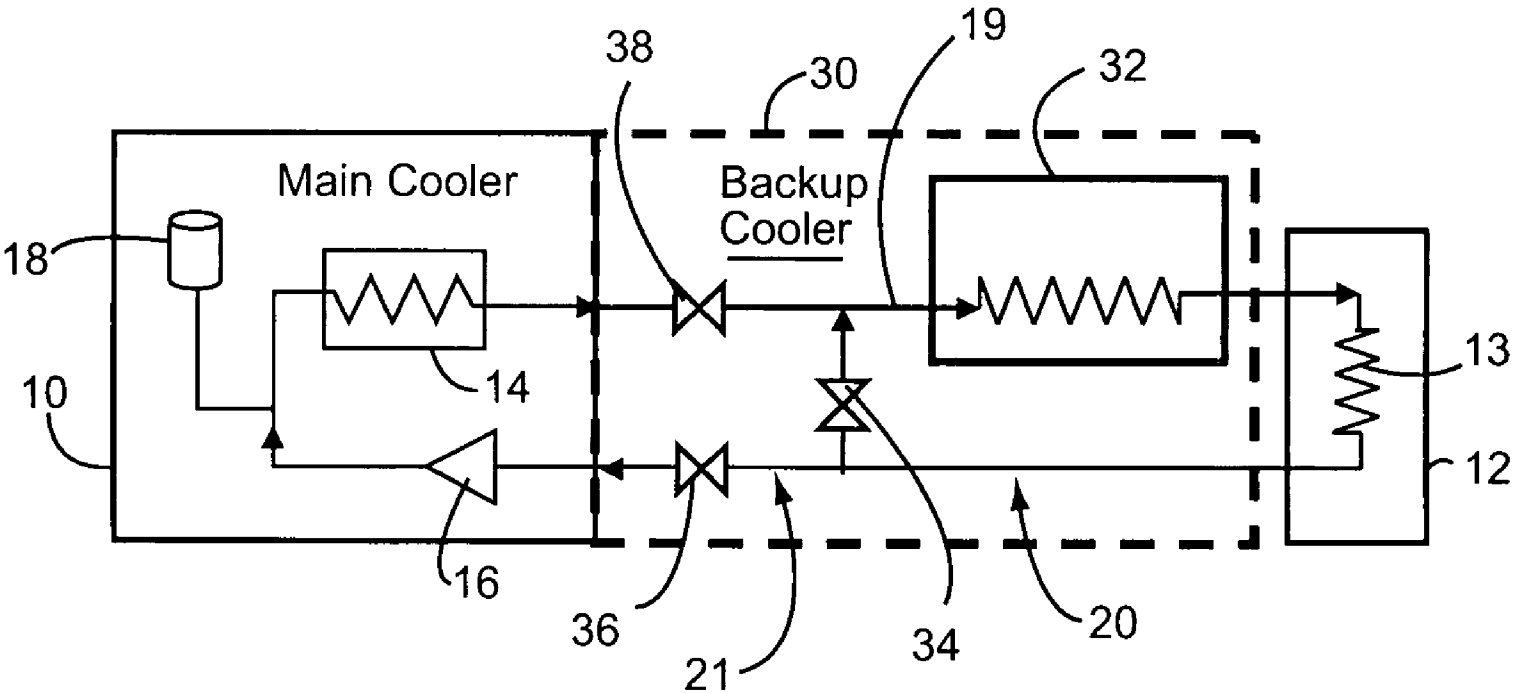
FIG. 1 is a schematic diagram of a cryogenic refrigeration system with backup cooler for supplying cooling fluid to a thermal load.

FIG. 1 is a schematic diagram of a main cryogenic refrigeration system 10 for cooling a thermal load 12. The thermal load 12 may be, for example, superconducting field winding coils 13 in a rotor of a synchronous electric HTS generator. While the exemplary embodiments disclosed below are cryogenic refrigeration systems using a compressible gas, e.g., helium, as a cooling fluid, other cooling fluids such as a liquid may be used.

Figure 4:
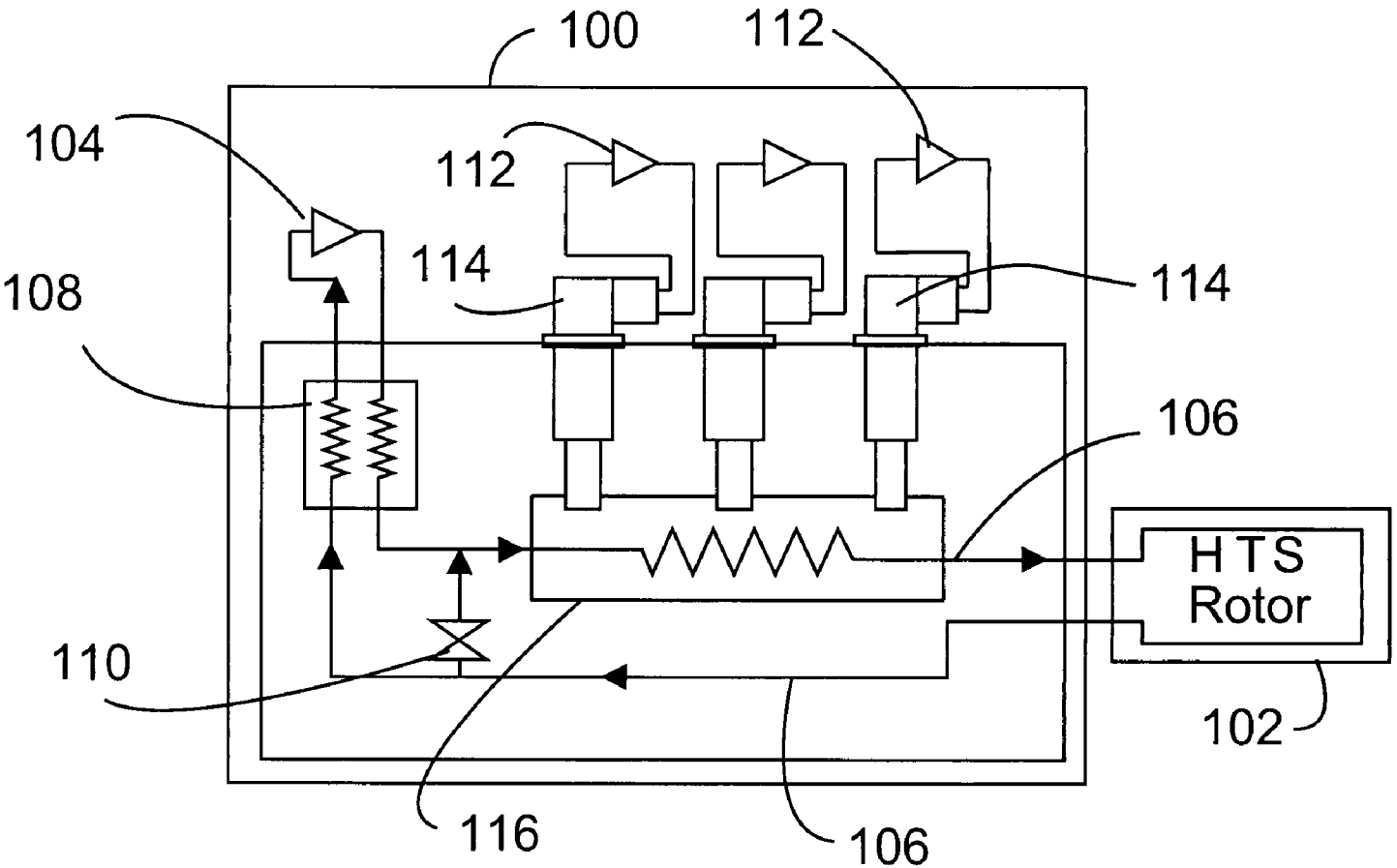
Figure 4 (PRIOR ART)
FIG. 4 is a schematic diagram of a conventional cryogenic refrigeration system that is representative of Gifford-McMahon, Pulse Tube and Stirling Type systems.
Figure 5:
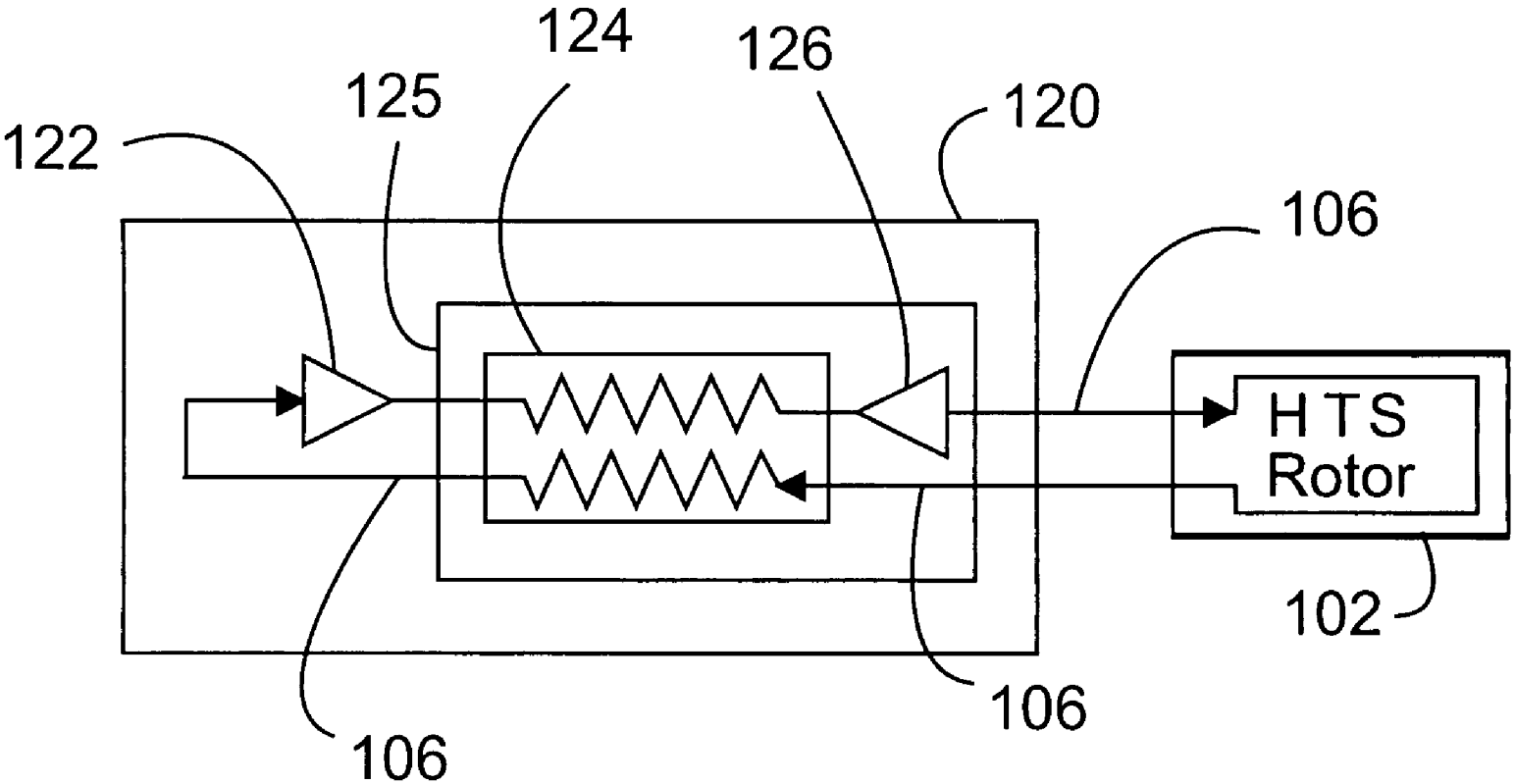
Figure 5 (PRIOR ART)
FIG. 5 is a schematic diagram of a conventional cryogenic refrigeration system that is representative of a Reverse-Brayton type system.

The main refrigeration system 10 includes, for example, a heat exchanger 14 and a re-circulation device 16 such as a re-circulating compressor fan or pump. For example, the main refrigeration system 10 may be one of the refrigeration systems 100, 120 shown in FIGS. 4 and 5. The re-circulation device 16 compresses and supplies warm temperature gas, e.g., 300° K, from the thermal load 12 to the heat exchanger 14. The re-circulation device may include a storage container 18 of cooling fluid. The heat exchanger 14 cools the gas received from re-circulation device 16 to a cryogenic temperature. The cooled gas flows through a fluid feed line 19 in a gas circuit 20 that passes through and between the main cooler 10 and the load 12. The gas circuit 20 also includes a fluid return line 21 for warmed gas flowing from the thermal load 12 to the main cooler 10.

A backup cooling system 30 supplements the main cooling system 10 for a thermal load 12, such as a HTS generator. The backup cooling system may be between the main cooler 10 and thermal load 12, and enclose a portion of the feed and return lines 19, 21. The backup system 30 includes a cold box (defined by the dotted lines) arranged between the main refrigeration system 10 and the thermal load 12. The cold box may be a well insulated chamber intended to maintain for limited periods of time, e.g., several hours, cryogenic temperatures within the box. The backup system cold box includes a heat exchanger 32 to cool the fluid in the feed line 19 flowing to the rotor, a bypass valve 34, an isolation valve 36 in the return line 21 and a second isolation valve 38 in the feed line 19. The isolation valves may be in the cold box and towards the main cooler 10. The isolation valves may be opened and closed from outside of the cold box.

During normal operation of the main cooling system 10, the bypass valve 34 is closed and the isolation valves 36, 38 are open. Cooling fluid flows through the feed and return lines 19, 21 between the main cooling system and thermal load. The heat exchanger 32 does not exchange a significant amount of heat with the cooling fluid. During normal operation, the backup system is relatively inoperative.

The backup system 30 is available to provide cryogenic cooling fluid to the windings 13 of the rotor 12 when the main refrigeration system 10 is inoperative due to a main refrigeration component failure or maintenance activity. The backup system 30 is activated by shutting the isolation valves 36, 38 to isolate the main cooling system. The bypass valve 34 is opened to provide a cooling fluid loop for cooling fluid circulating through the backup system (but not the main cooler 10) and the rotor 12. The heat exchanger 32 removes heat from the cooling fluid flowing to the rotor. Heat extracted from the cooling fluid by the heat exchanger is discharged externally of the cold box or adsorbed by the heat exchanger.

The backup system 30 relies on the inherent pumping action of the centrifugal forces from the rotor that act on the cooling fluid and the expansion of the cooling fluid in the rotor to circulate the cooling fluid through the rotor 12 and backup system 30. A separate cooling fluid pump in the backup system is generally not needed because cooling fluid is typically not needed when the rotor is stationary. When the rotor is not spinning, it is usually acceptable for the rotor to slowly warm. If there is a need to cryogenically cool the stationary rotor field winding coil, the rotor may be periodically spun at a Full-Speed No-Load (FSNL) condition to pump the cooling fluid through the rotor coil and thereby periodically cool the coil 13. In addition, a backup system pump may be included in the feed or return lines.

The heat exchanger 32 may be one of a variety of different types of heat exchangers. For example, the heat exchanger may be a thermal capacitor that has a large mass of solid material (such as lead or solder) with a high value of specific heat. The fluid from the main cooler cools the heat exchanger mass 32 during the normal cooldown operation. The cooled thermal mass 32 is available to cool the cooling fluid (rotor coolant) during backup operation (when the isolation and bypass valves closes off the main cooler) for a time limited by the warm-up rate of the mass.

Figure 2:
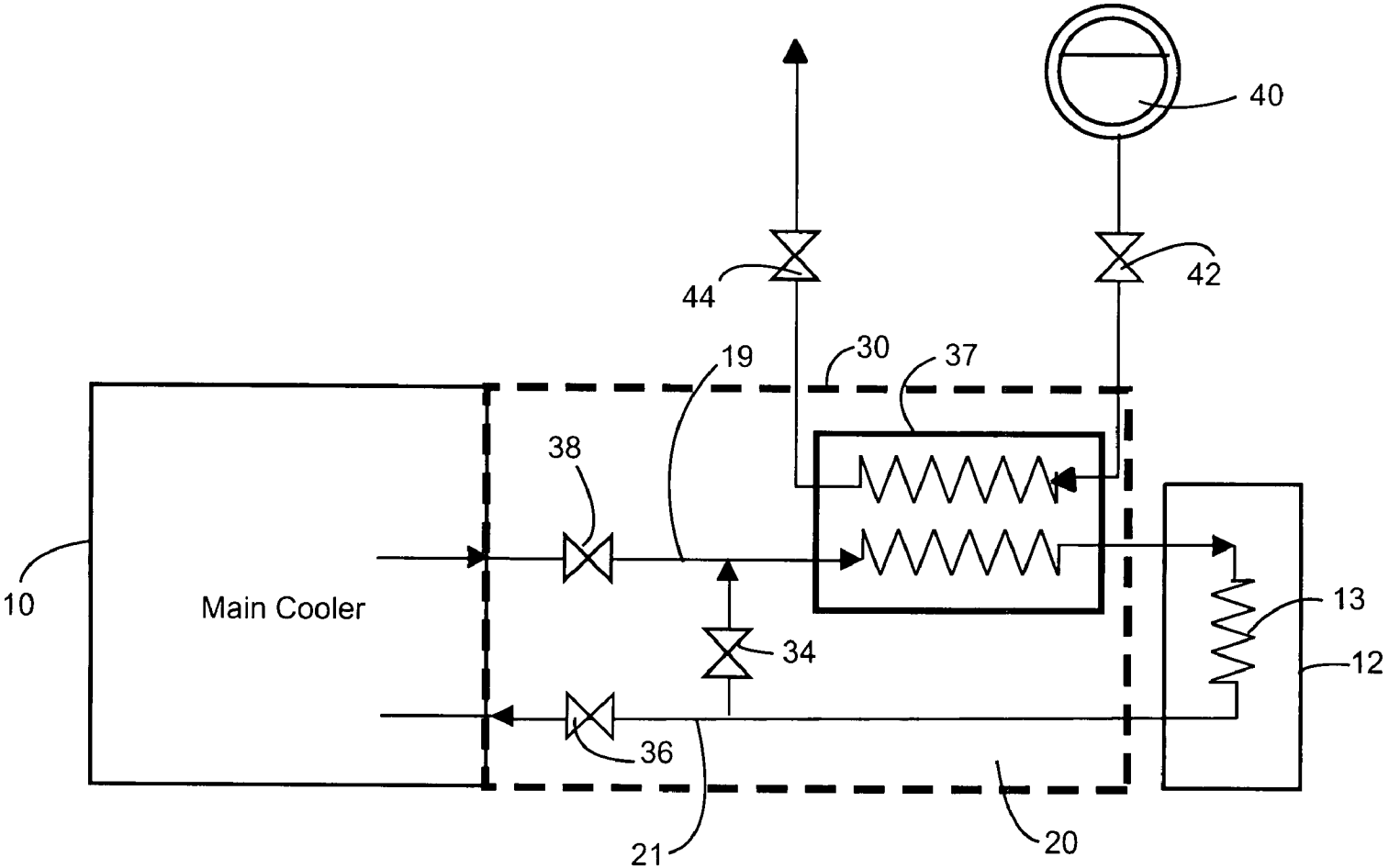
FIG. 2 is a schematic diagram of a refrigeration system with a second backup cooler.

FIG. 2 is a schematic diagram of a backup cooling system 30 having a closed-path heat exchanger 37. In this closed-path heat exchanger, a cryogen, e.g., liquid helium, flows from a storage tank 40 through a flow control valve 42, through the heat exchanger 36 where it cools the rotor coolant. In cooling the rotor coolant, the heat exchanger may convert the cryogen from the tank from a liquid to vapor, which is finally discharged to atmosphere through a vent valve 44.

Figure 3:
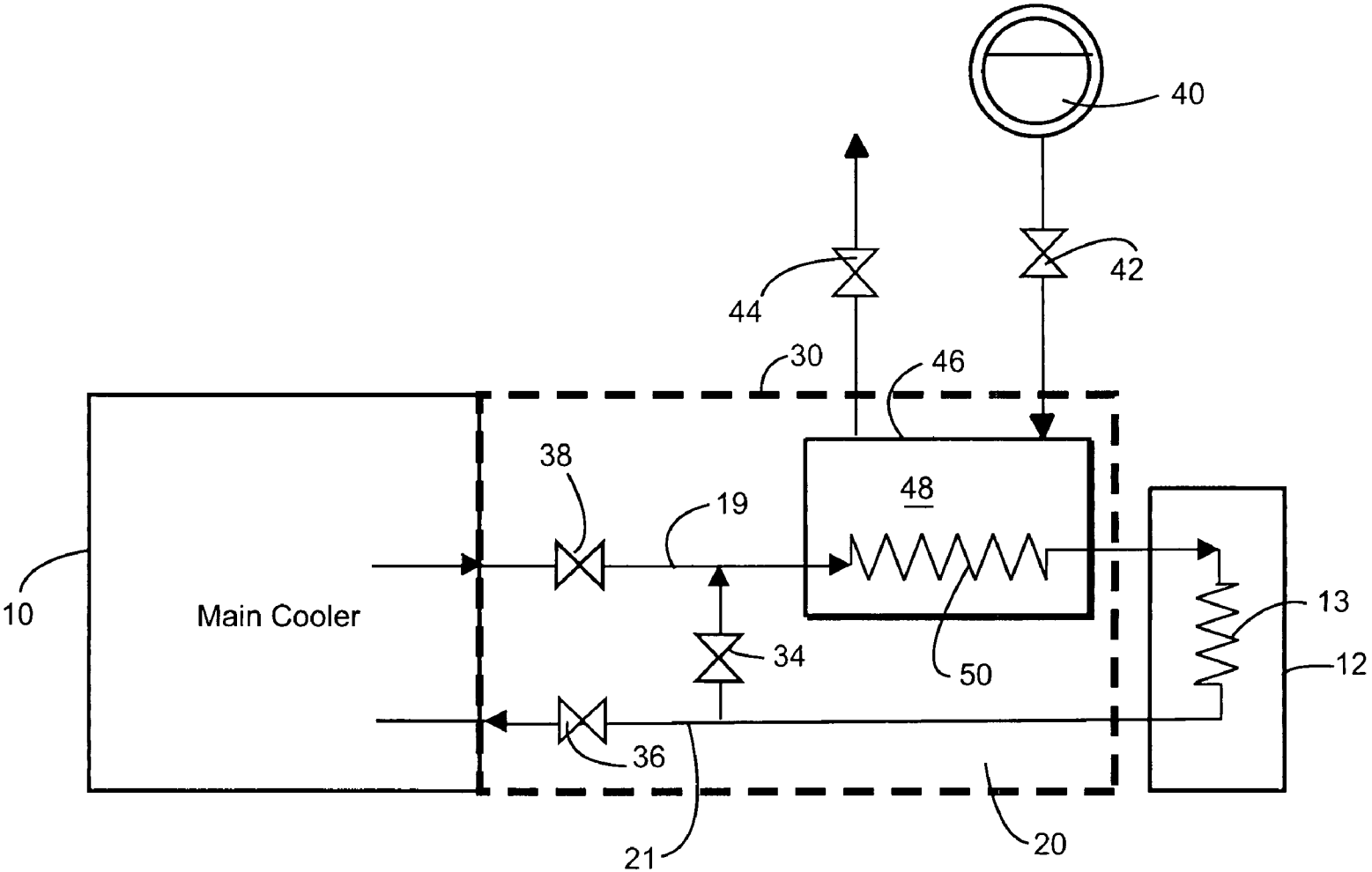
FIG. 3 is a schematic diagram of another refrigeration system having a third backup cooler.

FIG. 3 shows a backup cooling system 30 with an open-path heat exchanger 46. The cold cryogen from the storage tank 40 flows into a chamber 48 of the heat exchanger 46. The cold cryogen directly surrounds the surfaces of the heat exchanger tube(s) 50 carrying the rotor coolant flowing through the feed line 19 to the rotor. The heat exchanger 46 may also contain a significant thermal mass, e.g., solid or porous block, that also acts as a thermal capacitor.

During a normal cooldown operation, the main cooler 10 cools the cooling fluid, the isolation valves 36, 38 are opened and the bypass valve 34 is closed. During normal cooldown operation, the heat exchangers shown in FIGS. 2 and 3 can be cooled with the external cryogen to supplement the amount of cooling to the rotor for a faster cooldown operation.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A cooling system for providing cryogenic cooling fluid to a thermal load, the system comprising:

a main cryogenic refrigeration system;

a cryogenic cooling fluid feed line having a feed line outlet coupled to the thermal load and a feed line inlet coupled to the cryogenic refrigeration system;

a cryogenic cooling fluid return line having a return line inlet coupled to the thermal load and a return line outlet coupled to the cryogenic refrigeration system; and a second cooling system further comprising isolation valves attached to the feed line and return line wherein each of said valves has a closed position and an open position, a bypass line extending between the feed line and return line, a bypass valve and a cooling device attached to one of said feed line and return line.

2. A cooling system as in claim 1 wherein the second cooling system further comprises a cold box housing the bypass line and the cooling device.

3. A cooling system as in claim 1 wherein the cooling device is a heat exchanger.

4. A cooling system as in claim 1 wherein the cooling device is an open heat exchanger.

5. A cooling system as in claim 1 wherein the cooling device is a closed heat exchanger.

6. A cooling system as in claim 3 further comprising a storage tank of cryogen coupled to the heat exchanger.

7. A cooling system as in claim 3 further comprising a storage tank of cryogen coupled to the heat exchanger, wherein said heat exchanger is an open path exchanger.

8. A cooling system as in claim 3 further comprising a storage tank of cryogen coupled to the heat exchanger, wherein said heat exchanger is a closed path exchanger.

9. A cooling system as in claim 1 wherein the thermal load is a superconducting winding of a rotor in a generator.

10. A cooling system as in claim 1 wherein the cooling device is coupled to the feed line.

11. A cryogen backup cooling system adapted to be positioned between a main cryogen cooling system and a thermal load, the backup cooling system comprising:

a first isolation valve in a cooling fluid feed line, wherein said feed line having a cooling fluid feed line inlet connectable to the main cryogen cooling system and an outlet connectable to the thermal load;

a second isolation valve in a cooling fluid return line, said return line having a return line inlet connectable to the thermal load and an outlet to the return line connectable to the main cryogen cooling system;

a bypass line connectable to the feed line between the first isolation valve and the thermal load and connectable to the return line between the second isolation valve and the thermal load, and a cooling device connected to one of the return line and feed line between the bypass line and the thermal load.

12. A cryogen backup cooling system as in claim 11 further comprising a cold box enclosing the bypass line and cooling device.

13. A cryogen backup cooling system as in claim 11 wherein the cooling device is a heat exchanger.

14. A cryogen backup cooling system as in claim 11 wherein the cooling device is an open heat exchanger.

15. A cryogen backup cooling system as in claim 11 wherein the cooling device is a closed heat exchanger.

16. A cryogen backup cooling system as in claim 15 further comprising a storage tank of cryogen coupled to the heat exchanger.

17. A cryogen backup cooling system as in claim 15 further comprising a storage tank of cryogen coupled to the heat exchanger and a vent line for the cryogen coupled to the heat exchanger.

18. A cooling system as in claim 11 wherein the thermal load is a superconducting winding of a rotor in a generator.

19. A cooling system as in claim 11 wherein the cooling device is coupled to the feed line.

20. A method of providing a cryogen cooling fluid to a thermal load, the method comprising:

cooling the fluid in a main cryogenic refrigerator;

transferring the cooled fluid from the main cryogenic refrigerator through a feed line to the thermal load;

cooling the thermal load with the cooled fluid and returning the fluid through a return line to the main cryogenic refrigerator;

blocking the fluid flowing from and to the main cryogenic refrigerator;

circulating the fluid from the return line through a bypass line and to the feed line, while blocking the main cryogenic refrigerator, and cooling the circulating fluid in a heat exchanger.

* * * * *